United States Patent [19]

Ebner

[11] 4,171,628

[45] Oct. 23, 1979

[54] MAGNETIC CONTROL SYSTEM FOR CIRCULAR KNITTING MACHINES

[75] Inventor: Siegfried Ebner, Remshalden-Geradstetten, Fed. Rep. of Germany

[73] Assignee: C. Terrot Soehne Gmbh & Co., Stuttgart, Fed. Rep. of Germany

[21] Appl. No.: 678,903

[22] Filed: Apr. 21, 1976

[30] Foreign Application Priority Data

May 22, 1975 [DE] Fed. Rep. of Germany ..... 2522699

[51] Int. Cl.[2] ..... D04B 15/78

[52] U.S. Cl. ..... 66/219

[58] Field of Search ..... 66/50 R, 154 A, 25

[56] References Cited

U.S. PATENT DOCUMENTS

| | | | |
|---|---|---|---|
| 3,518,845 | 7/1970 | De Cerjat | 66/50 R |
| 3,851,500 | 12/1974 | Wolfshagen | 66/50 R |
| 3,861,173 | 1/1975 | Klinkelin | 66/50 R |
| 3,863,465 | 2/1975 | De Cerjat et al. | 66/50 R |
| 3,919,863 | 11/1975 | Sawazaki | 66/50 R |
| 3,948,062 | 4/1976 | Sumitomo | 66/50 R |
| 3,972,206 | 8/1976 | Mureso | 66/50 R |
| 4,033,148 | 7/1977 | Mureso | 66/50 R |

FOREIGN PATENT DOCUMENTS

| | | | |
|---|---|---|---|
| 2153428 | 10/1973 | Fed. Rep. of Germany | 66/50 R |

*Primary Examiner*—Werner H. Schroeder
*Assistant Examiner*—Andrew M. Falik

[57] ABSTRACT

An improved magnetic pattern control system for circular knitting machines. Each system includes a bar forming a bearing surface. Selector elements of the knitting machine are adapted to be tipped or pivoted about the bar as they pass the bar to move corresponding knitting needles into a knitting or non-knitting position. The bar extends in the direction of travel of the selector elements. A plurality of electromagnets are mounted at each selection station of the circular knitting machine. Each electromagnet has a pair of polar surfaces. The midpoint between all pairs of polar surfaces coincide with respect to each other and these coinciding midpoints are therefore equidistant from the bar forming the bearing surface.

13 Claims, 8 Drawing Figures

MAGNETIC CONTROL SYSTEM FOR CIRCULAR KNITTING MACHINES

BACKGROUND OF THE INVENTION

The invention relates to a magnetic control system for circular knitting machines, intended for pattern-true control of selector elements, which may be tipped about a bearing surface forming part of pivot means, extending in their direction of travel, comprising several electromagnets of which each has at least one pair of polar surfaces acting on the selector elements and where the polar surfaces have different spacings from this bearing surface.

Different magnetic control systems, of the aforesaid kind, for circular knitting machines, have already become known in which the period available for performance of the selecting operation is extended by the application of several electromagnets; two variations are possible in this connection: in the one variation, for example as disclosed by DT-OS 2,217,115, published on Oct. 26, 1972 which corresponds to U.S. Pat. No. 3,851,500, each selector element runs past the pairs of polar surfaces consecutively, and the electromagnets are energized in chronological sequence, whereas in the case of a second variation, selector elements of several types are applied, the number of types corresponding to the number of electromagnets, the different selector element types have several butts at different points for cooperation with the electromagnets, and the electromagnets are situated at different distances from the bearing surface depending on the position of these butts, so that the electromagnets may in each case act on one selector element type only during simultaneous energization, the period available for the selecting operation may thus be multiplied according to the number of electromagnets or of selector element types. It is apt to add moreover, that in the case of the second variation, the butt of the selector elements cooperating with one of the electromagnets in each case is situated at different levels in the different selector element types.

In both forms, the effective lever arm of the different electromagnets with respect to the bearing surface is then varied so that the selector elements may be tipped. This is extremely disadvantageous, because efforts are obviously made in view of heat generation, to rate the power of the current pulses for the electromagnets at a minimum, and on the other hand, the fast-running modern circular knitting machines require relatively great selection forces, so that selection and thus pattern faults may be prevented reliably. Consequently, in the case of the known magnetic control system, it is the electromagnet having the shortest distance from the bearing surface which determines the power of the current or rather control pulses, if a complicated control system having different pulse levels for the different electromagnets is to be dispensed with.

SUMMARY OF THE INVENTION

It is therefore a general object of this invention to provide a magnetic control system which is no more complex in structure than the known magnetic control systems, but offers a more reliable selection of the knitting, respectively nonknitting needles of a circular knitting machine. It is proposed for this purpose, that a magnetic control system of the aforesaid kind be inventively so constructed that the respective midpoints of a plurality of pairs of polar surfaces coincide so that these midpoints are equidistant from the bearing surface forming the pivot means. If use is made of a number of selector elements of the type where each has areas or butts for cooperation with the electromagnets disposed at the point at which the polar surfaces of the coacting electromagnet are positioned, and where the number of butts corresponds to the number of electromagnets, the effective leverage of all electromagnets on the coacting selector element types is always identical. Consequently, control currents of identical intensity for all electromagnets can be used and therefore currents of lesser intensity than in the prior art may be applied. As a result a more reliable selecting operation than in the case of the known magnetic control systems is obtained.

In a preferred form of embodiment of the inventive magnetic control system, the pairs of polar surfaces are arranged in a row, and are in particular equidistant and positioned one above another at one side of the bearing surface, and the extreme polar surfaces of this, the polar surfaces next to the extreme ones, and if appropriate those next to them, etc. form the pair of polar surfaces of an electromagnet in each case.

It is also possible, however, to operate with the inventive magnetic control system according to the principle corresponding to DT-OS 2,217,115 (U.S. Pat. No. 3,815,500), i.e. to energize the electromagnets consecutively if the selector elements have areas for cooperation with all polar surfaces, i.e. for example an uninterrupted area which comes into contact consecutively with all pairs of polar surfaces. In such case too, it is assured that the effective leverage of each electromagnet is identical, i.e. that the tipping torque engendered by the magnetic adhesion forces does not vary whilst the selector elements run past the electromagnets.

It should be emphasized in particular that this advantage may be obtained without additional expense, merely by an appropriate coordination between the polar surfaces and the different electromagnets.

In the case of the known magnetic control systems, the different elements are commonly secured in appropriate recesses of a housing or frame, by immobilizing them in these recesses by being cast-in with casting resin. The end surface of the magnetic control system facing towards the selector elements is then ground to a smooth surface finish. Practice has now demonstrated that no durable and sufficiently stable immobilization of the electromagnets or rather of their polar surfaces with respect to the housing of the magnetic control system may be obtained by the casting-in method. For this, reason, it is proposed in accordance with the invention, that at least one plate comprising excisions for the extremities of the electromagnet poles forming the polar surfaces be secured on the housing. Such a plate of non-magnetic material may be secured on the housing of the magnetic control system in extremely stable and precise manner, so that if the excisions are produced with appropriate precision, the polar surfaces of the electromagnets are also durably and precisely immobilized. The plate acts as a gage at the same time, during installation of the electromagnets in the housing. The latter may obviously also be complementarily cast-in within the housing.

In the case of the known magnetic control system, for example as disclosed by DT-OS 2,217,115 (U.S. Pat. No. 3,851,500), a bar acts as a bearing surface, and at least two magnetic tracks formed by permanent magnetic systems are also incorporated. One of these magnetic tracks serves the purpose of bringing the selector elements up to the polar surfaces of the electromagnets and, behind the latter, of holding the selected or non-selected selector elements in their position, whereas the second magnetic track initiates the tipping action at the so-called selection or control point and lifts the selected or non-selected selector elements off the polar surfaces of the electromagnets. As already stated, the different elements of the known magnetic control systems, i.e. the polar surfaces of the electromagnets, the polar surfaces of the permanent magnet systems and the bar constituting the bearing surface, were ground jointly until now, which is extremely unsatisfactory, because the different elements consist of different materials and may consequently only be ground jointly in extremely unsatisfactory manner. For this reason, in a preferred form of embodiment of the inventive magnetic control system, the bar acting as the bearing surface and the permanent magnet systems are inserted in the housing in a manner that enables it to be assembled or disassembled. This measure renders it possible to install the electromagnets and grind their polar surfaces first. Consequently, they may be ground flat in view of the small length of the polar surfaces of the electromagnets, whereupon the already ground - that is to say appropriately concavely ground - permanent magnet systems and the bar acting as the bearing surface are installed in the housing. The possibility of installation of these elements may be so organized, without difficulty, that the elements may be aligned.

In the case of the known magnetic control systems, the permanent magnetic track is situated at the same side relative to the bearing surface as the polar surfaces of the electromagnets. The arrangement comprises the wholly separate permanent magnet systems in front and behind the electromagnets. In accordance with the invention, it is now proposed that one of the magnetic tracks and in particular the magnetic track situated at the same side of the bearing surface as the polar surfaces of the electromagnets, be constructed as a continuous supporting bar for the selector elements, and not be interrupted by said polar surfaces; the magnetic field of this magnetic tracks is interrupted at the point of the row formed by the polar surfaces of the electromagnets. The adjusting of a second permanent magnet system for this magnetic track may be avoided in this manner, without impairing the selecting function of the electromagnets. It is advantageous to obtain as rectilinear as possible an outline of the magnetic field at the point of its interruption, i.e. that the field strength zero prevails throughout the width of the control or selection point and that the magnetic field rises to its full value immediately at either side of the control or selection point. This desirable rectangular extension may be approximated quite satisfactorily, if the said magnetic track has permanent magnets of opposed polarity situated at either side of the interruption in order to form this interruption of the magnetic field. If the magnetic track is intended to form a continuous supporting bar, i.e. not be interrupted at the selection or control point, it is advisable to position the permanent magnets between two pole pieces whereof at least one forms the supporting bar and has at least one excision behind its end face at the point of magnetic field interruption. Due to this excision, the retention of the rectangular magnetic field outline is assured despite the fact that at least one pole piece of the permanent magnets forms a continuous supporting bar for the selector elements.

BRIEF DESCRIPTION OF THE DRAWING

Other advantages, features and details of the inventive structure may be gleaned from the accompanying claims and/or the following specification or from the accompanying graphic illustration of a preferred form of embodiment of the inventive magnetic control system; the figures show:

DETAILED DESCRIPTION

Figure 1:
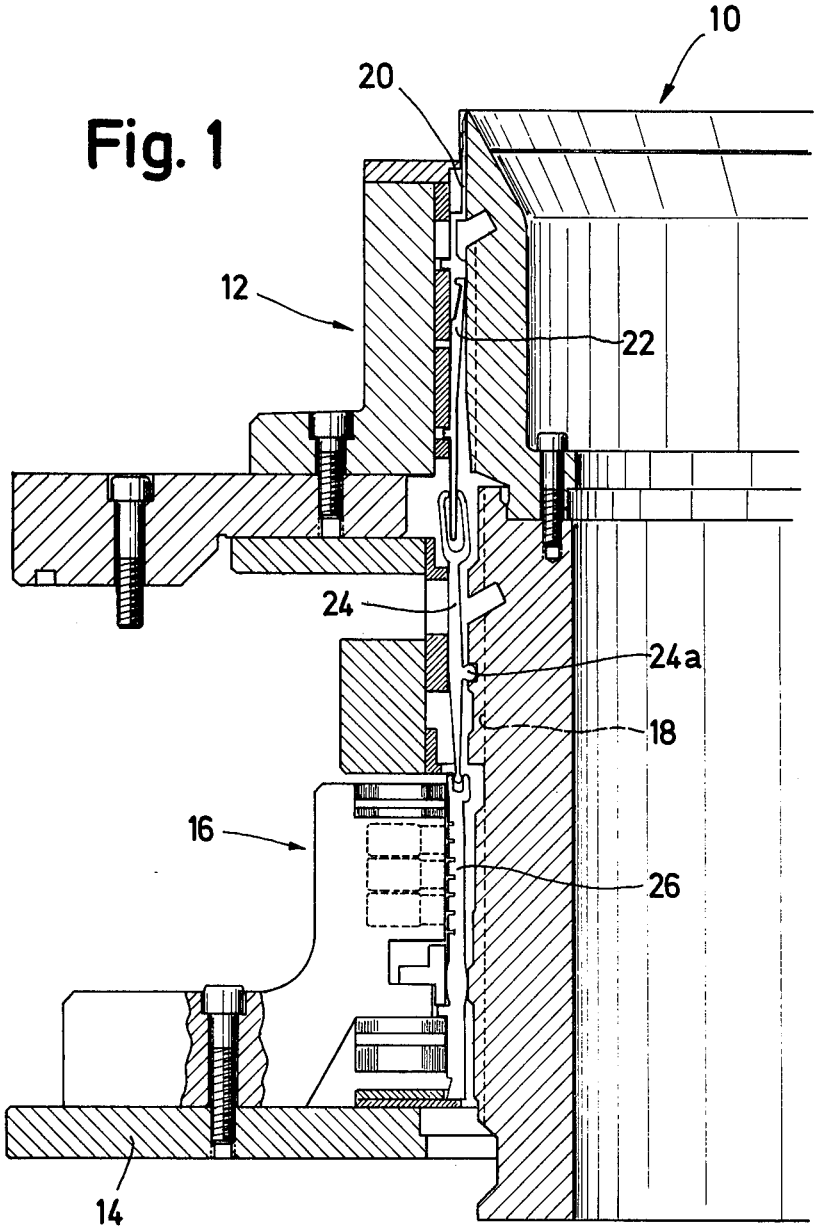
FIG. 1, a cross-section through a circular knitting machine equipped with an inventive magnetic control system.

FIG. 1 will be described quite briefly only, to elucidate the arrangement and action of the inventive control system.

This figure shows a part of a rotatable needle cylinder 10 and a cam casing 12 below which are situated control magnet systems 16 secured on a bearing ring 14, whereof the number corresponds to the number of the knitting systems in the cam casing 12, and which are circularly arranged around the needle cylinder. The latter comprises grooves 18 whereof each receives, one below the other, a needle 20, a pusher 22 hooked into the same is articulated manner, a forked hook 24 pivotable about the projection 24*a*, as well as a hook-like selector element 26. If the latter is kept in its position shown in FIG. 1 in the course of being rotated together with the needle cylinder, the pusher 22 is driven out and the needle 20 knits; if, on the contrary, in the course of a further rotation of the needle cylinder the selector element 26 according to FIG. 1 is pivoted counterclockwise in one system, the corresponding pusher 22 is swung away by the cam casing 12 so that the needle 20 hooked in it does not knit.

The matter described until now is not an object of the invention, so that a more detailed elucidation may be omitted.

The overall structure of an inventive magnetic control system will now be described with reference to FIGS. 2 and 3.

A housing 30 comprises recesses 32 to 38 for a bottom permanent magnet system 40, a bearer bar 42, several electromagnets which will be described in particular in the following, as well as for a top permanent magnet system 44. It is particularly appropriate that the recesses 32 and 38 are open downwards and upwards, respectively, so that the permanent magnet system 40 and 44 may easily be inserted in the housing 30 and secured to the same by means of bolts 45 and 48, respectively. Bolts which have not been illustrated in particular, however, also appropriately serve the purpose of securing the bearer bar 42. The bottom permanent magnet system comprises two pole pieces 50 and 52 as well as a permanent magnet 54 situated between them, whereof its upper and lower surfaces providing its polar surfaces bear against the pole pieces. As is not apparent from the drawing, the end faces 50*a* and 52*a* of the pole pieces 50 and 52 are chamfered in the direction of travel of the selector elements 26. This is known per se, for example from DT-OS 2,217,115 (U.S. Pat. No. 3,851,500), and this matter will be dealt with in particular in the description of the operation of the inventive magnetic control system.

Figure 3:
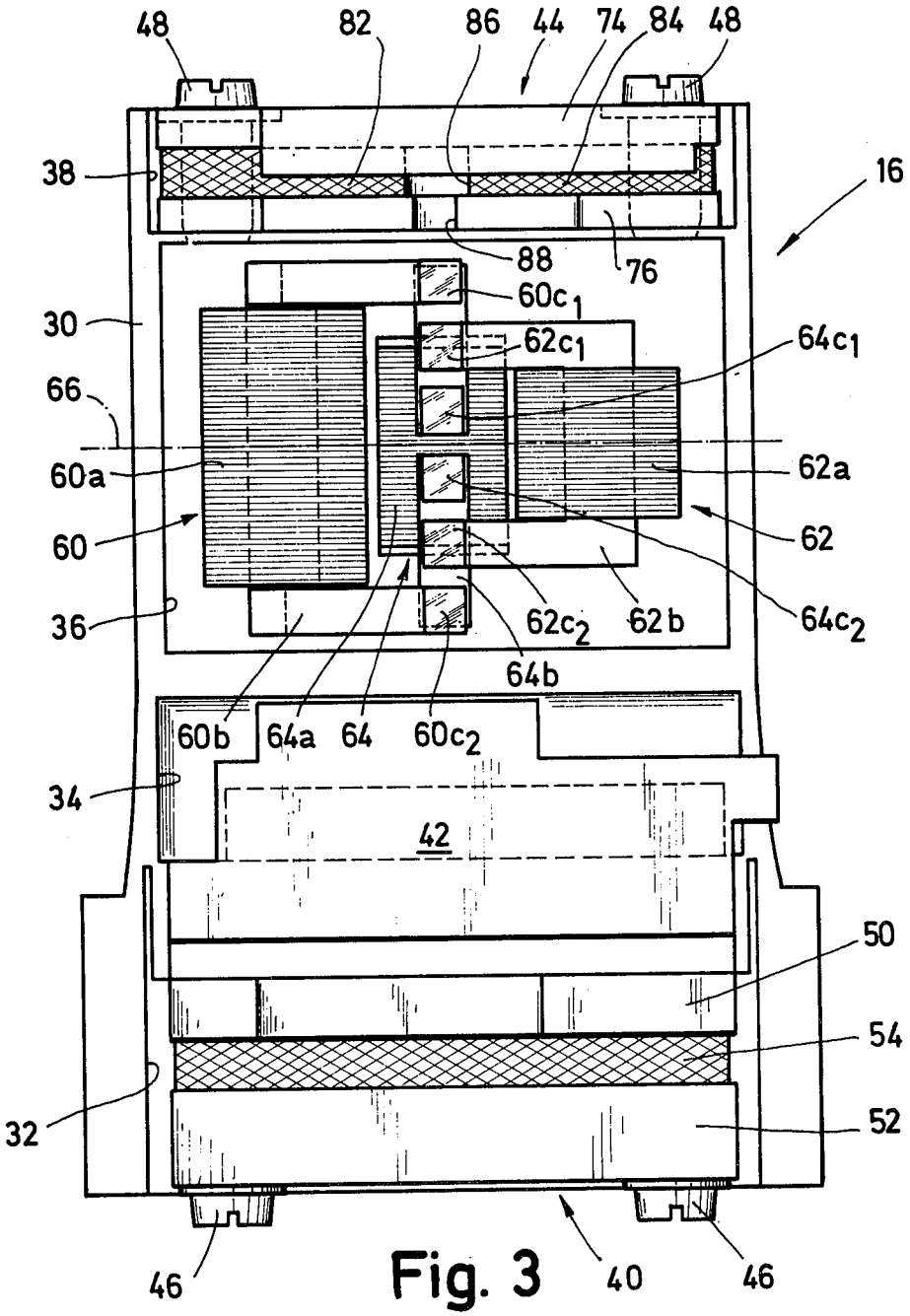
FIG. 3, a view of the magnetic control system along line 3—3 in FIG. 2, parts situated in front of the electromagnets having been removed.

The recess 36 receives three electromagnets 60, 62 and 64, whereof the arrangement is more clearly shown in FIG. 3. Each of these electromagnets has a coil 60*a*, 62*a*, 64*a* as well as a core 60*b*, 62*b*, 64 *b*, and the cores form polar surfaces $60c_1$, $60c_2$; $62c_1$, $62c_2$; $64c_1$, $64c_2$ which are arranged in a quite specific and inventive manner: the polar surfaces appertaining to one electromagnet in each case are symmetrically positioned with respect to the line 66 drawn in FIG. 3 and which extends parallel to the bearer bar 42. The center between the pair of polar surfaces $60c_1$, $60c_2$ thus lies on the line 66, just as the center between the pair of polar surfaces $62c_1$, $62c_2$ and the center between the pair of polar surfaces $64c_1$, $64c_2$, so that the centers between the pairs of polar surfaces all have the same distance from the bearer bar 42.

Figure 2:
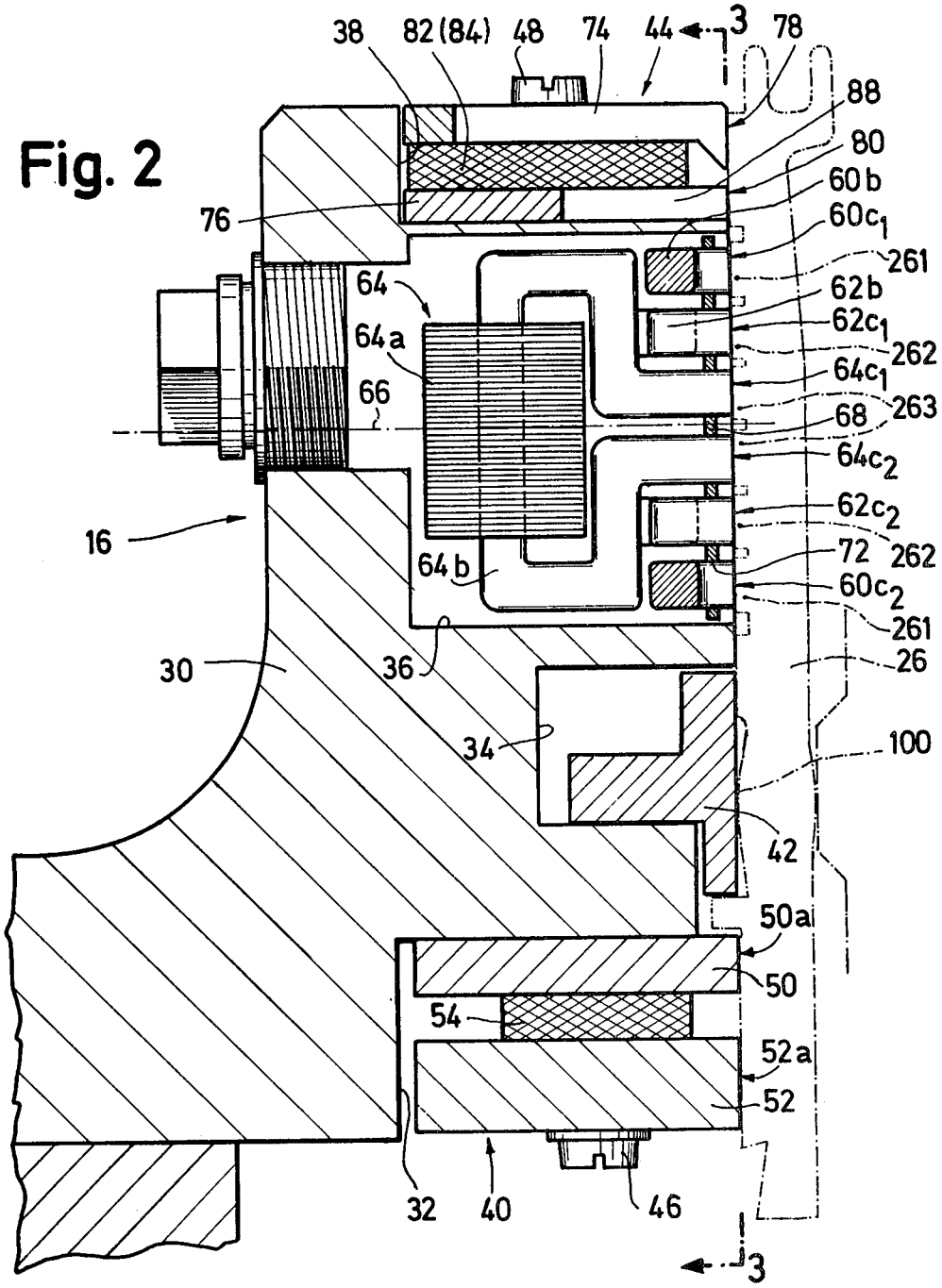
FIG. 2, a cross-section corresponding to FIG. 1 through one of these magnetic control systems depicted on a larger scale than in FIG. 1.
Figure 4:
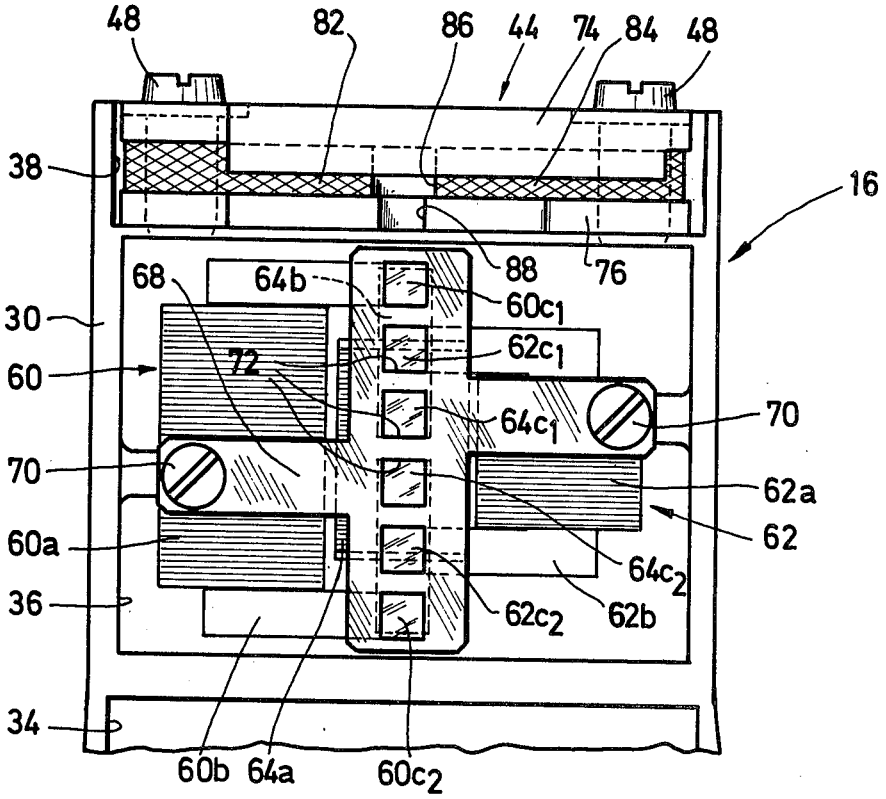
FIG. 4, a view similar to FIG. 3 with parts omitted so that the electromagnets as well as a plate for securing the polar surfaces of the electromagnets can be seen.

A pattern-like or template-like plate 68 (see FIG. 4) which is not illustrated in FIGS. 2 and 3, which is secured to the housing 30 by two bolts 70 and has perforations 72 for the extremities of the cores 60*b* and 64*b* forming the polar surfaces, is situated in front of the coils of the electromagnets. This plate thus ensures that the polar surfaces always assume one and the same and quite specific position if the electromagnets 60 and 64 are inserted on the recess 36 of the housing 30 and are cast-in within the recess, the casting resin used for this purpose is not illustrated in the drawing. After the electromagnets are inserted and cast-in, their polar surfaces are ground flat, that is to say before the permanent magnet systems 40 and 44 and the bar 42 are installed in the housing 30.

The polar surfaces $60c_1$ to $60c_2$ lying one above another in a row, form the so-called selection or control station of the magnetic control system.

The top permanent magnet system 44 equally comprises two pole pieces 74 and 76, whereof the end faces have been marked 78 and 80. The end face 78 of the upper pole piece forms a continuous supporting bar, not interrupted at the selection or control station, for the selector elements 26, which is, however, slightly chamfered at the point at which the selector elements run into the magnetic control system, just like the bearer bar 42 and the end faces 50*a* and 52*a* of the bottom permanent magnet system 40 (not illustrated), in order to ensure trouble-free run-in of the selector elements into the magnetic control system. The end face 78 of the top pole piece 74, moreover, and in accordance with the invention, stands a little proud and preferably by 0.02 mm, of the lower end face 80, so that the selector elements 26 come into contact with one only of the two end faces of the pole pieces of the top permanent magnet system 44, upon running past.

Figure 5A:
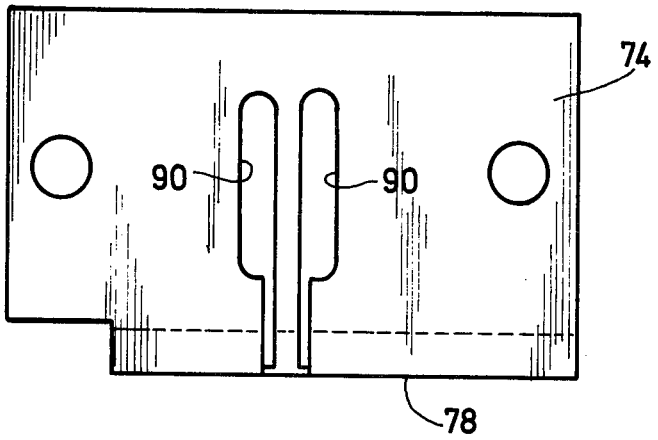
FIGS. 5*a* to 5*c*, plan views of different forms of embodiments of the upper pole pieces of the upper permanent magnetic track of the magnetic control system.
Figure 5B:
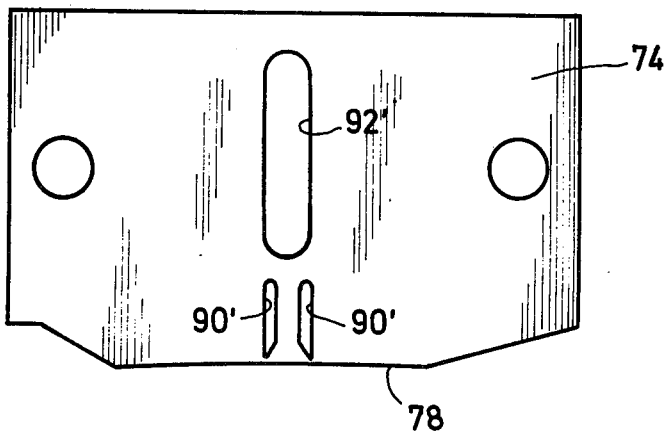
Figure 5C:
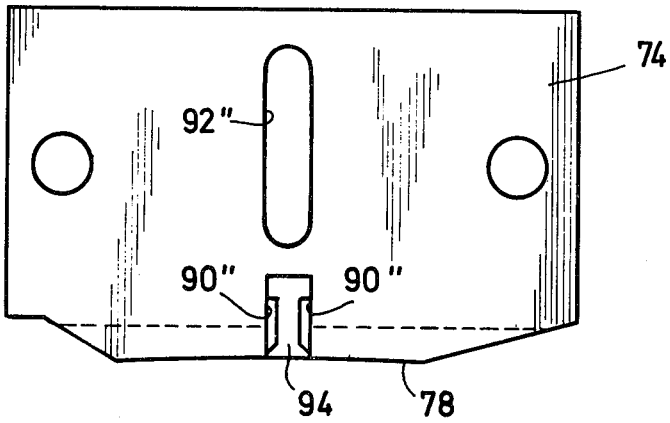
Figure 6:
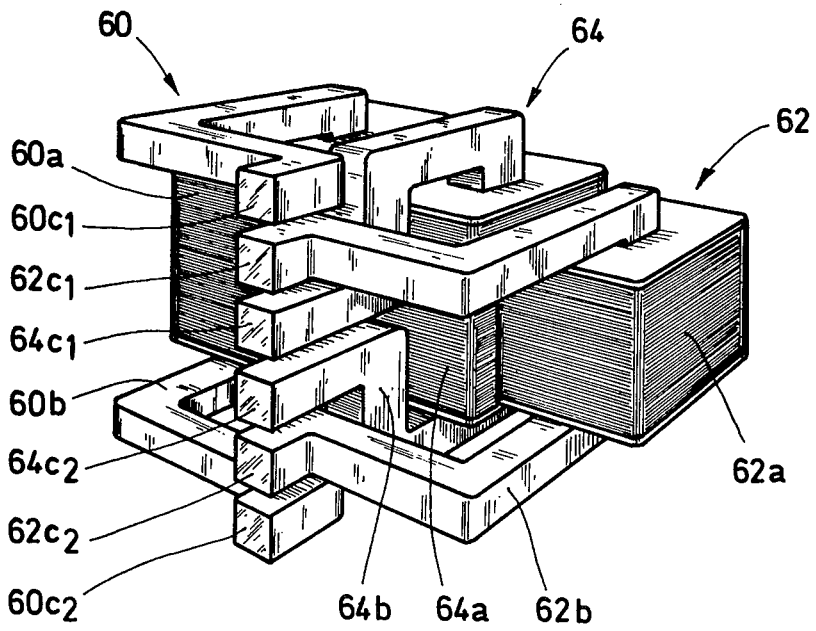
FIG. 6, an isometric view of three electromagnets of the control system of the invention of FIGS. 1 and 2.

So that the magnetic field of the top permanent magnet system 44 may be interrupted above the control station, i.e., above the row of the polar surfaces $60c_1$ to $64c_2$, the magnetic field strength plotted against the path of the selector elements 26 is as rectangular as possible, the following measures were applied: two permanent magnets 82 and 84 with their polar surfaces provided by their upper and lower surfaces but with opposed polarity, are situated between the pole pieces 74 and 76 of the top permanent magnet system, a gap 86 being present between them, which is a little wider than the polar surfaces $60c_1$ to $64c_2$, i.e., than the control station. Since, moreover, the selector elements 26 bear only against the upper end face 78 of the top permanent magnet system 44, the lower pole piece 76 of this permanent magnet system has a forwardly open, i.e., approximately U-shaped in plan view, excision 83 above the control station. Measures were finally also applied in respect of the upper pole piece 74 in order to interrupt the magnetic field at the control station: in accordance with the invention, the upper pole piece 74 actually has one of the forms illustrated in FIGS. 5*a* to 5*c*. Accordingly, behind the continuous end face 78, the width of the control station is defined. Thus, FIGS. 5*a*, 5*b* and 5*c* depict three different embodiments of the upper pole shoe 74 for the upper permanent magnet system 44. The embodiment of FIG. 5*a* has a pair of symmetrically arranged cutouts 90. The pole piece 74 of FIG. 5*b* has a centrally arranged cutout 92' and a pair of cutouts 90'. This pole piece 74 of FIG. 5*c* has a control cutout 92''.

In the form of the embodiment according to FIG. 5*a*, a rearwardly widening form of a pair of excisions 90 is provided in the pole piece 74. For reasons connected with production, it may be appropriate in particular circumstances, for the excisions delimiting the control station to be formed by an insert 94 which is produced as a separate component and then inserted into a marginally open notch in the pole piece and soldered on at this point for example (See FIG. 5*c*).

As is apparent from FIG. 2, for example, the selector elements 26 have several butts for cooperation with the polar surfaces of the electromagnets 60 to 64. Since three electromagnets are used in the magnetic control system illustrated, the needle cylinder 10 is also equipped with three different types of selector elements 26, which differ in the positioning of the butts cooperating with the electromagnets. A first type of selector element is intended to cooperated with the electromagnets 60 or rather with the electromagnets 60 of all magnetic control systems and for this reason comprises a butt 261 at the level of the polar surfaces $60c_1$ and $60c_2$ in each case; a second type of selector element is intended to cooperate with the electromagnet 62 and for this reason comprises a butt 262 at the level of the polar surfaces $62c_1$ and $62c_2$ in each case; finally, a third type of selector element is intended to cooperate with the electromagnet 64, so that this type of selector element comprises a butt 263 at the level of the polar surfaces $64c_1$ and $64c_2$ in each case — all these butts are illustrated in FIGS. 1 and 2, but it is a matter of course that each selector element comprises only butts 261 or 262 or 263.

The selector elements bear with a curvature 100 against the bar 42 and may tip around this curvature. They also bear on the end faces 50*a*, 52*a* of the bottom permanent magnet system 40. The mode of operation of the inventive control system then is the following: As the selector elements run in, these come into contact, before the control station formed by the polar surfaces $60c_1$ to $64c_2$, with the end faces 50*a*, 52*a* of the bottom permanent magnet system 40, with the bar 42 and with the end face 78 of the upper pole piece of the top permanent magnet system 44. Since the end faces 50*a*, 52*a* of the bottom permanent magnet system 40 slope from the control station and extend away from the needle cylinder, and since moreover the magnetic field of the top permanent magnet system 44 has an interruption at the control station, all the selector elements 26 are tipped clockwise around the bar 42 while the electromagnets 60 and 64 are de-energized, according to FIG. 2, so that corresponding needles 20 knit. If the electromagnet appertaining to a particular selector element is energized, however, at the control station, it prevents a tipping action of the selector element at the control station under the action of the bottom permanent magnet system 40, and the holding force of the electromagnets 60 to 64 is so rated that a selector element 26 appertaining to an energized electromagnet lifts off the end faces 50*a*, 52*a* of the bottom permanent magnet system 40 at or behind the control station. In its further displacement, it is then prevented from tipping by the top permanent magnet system 44, whereof the holding force actually comes into action again behind the control station.

It should evidently also be considered to lie within the scope of the invention, if another electromagnet is incorporated, which acts via one polar surface only on corresponding selector elements, this polar surface being situated at the level of the centers of the other pairs of polar surfaces, i.e., at the level of the line 66.

It is apt to add, finally, that in the case of an oblique extension of the bottom magnetic track (permanent magnet system 40), the distances of the centers of the pairs of polar surfaces from the bar may correlatively also change, provided that the magnetic control system is one comprising electromagnets positioned one after another.

What is claimed is:

1. An improved magnetic pattern control system for circular knitting machines adapted for adjusting selector elements according to a pre-selected pattern according to which knitted fabric is produced by said knitting machine, the improvement comprising bearing surface means, said selector elements adapted to be tipped about said bearing surface means which extend in their direction of travel, a plurality of electromagnets whereof each comprises at least one pair of polar surfaces acting on the selector elements and whereof the polar surfaces have different vertical distances from said bearing surface means, the respective midpoints between all pairs of polar surfaces coinciding and being equidistant from said bearing surface means.

2. An improved magnetic pattern control system according to claim 1, wherein all of said polar surfaces are aligned in a row.

3. An improved magnetic pattern control system according to claim 1, comprising a housing which has a recess for receiving the electromagnets, said electromagnets being embedded in a resin-cast-in into the recess, said housing has secured to it at least one plate which has perforations adapted to receive the extremities of the poles of the electromagnets forming the polar surfaces.

4. An improved magnetic pattern control system according to claim 3, wherein said plate is fastened to the housing at either side of the row of polar surfaces.

5. An improved magnetic pattern control system according to claim 4, including at least two magnetic track means exchangeably mounted in said housing.

6. An improved magnetic pattern control system according to claim 5, wherein said bearing surface means and said magnetic track means are secured in the housing by means of bolts.

7. An improved magnetic pattern control system according to claim 6, wherein the polar surfaces of the electromagnets and the bearing surface means as well as the radially most inwardly disposed surfaces of the magnetic track means are adapted to be contacted by said selector elements and are concavely ground in order to be radially equidistant from the axis of the circular knitting machine.

8. An improved magnetic pattern control system for circular knitting machines adapted for adjusting selector elements according to a pre-selected pattern according to which knitted fabric is produced by said knitting machine, the improvement comprising bearing surface means, said selector elements adapted to be tipped about said bearing surface means which extend in their direction of travel, at least one electromagnet having a polar surface acting on the selector elements, the improvement further comprising a magnetic track means acting on the selector elements and extending in their direction of travel, said magnetic track means forms a continuous supporting surface for said selector elements, and a magnetic field surface for said selector elements, and a magnetic field acting on the selector elements and having a first, a second, and a third zone arranged one behind the other in the direction of travel of said selector elements, the magnetic field strength in said second zone being substantially smaller than in said first and third zone of the magnetic field, said second zone being disposed such that a selector element is within said second zone when it abuts the polar surface of said electromagnet.

9. An improved magnetic pattern control system according to claim 8, wherein in said second zone the magnetic field strength of said magnetic track means is substantially zero.

10. An improved magnetic pattern control system according to claim 8, wherein sad magnetic track means is situated at the same side of the bearing surface means as the polar surface of said electro magnet.

11. An improved magnetic pattern control system according to claim 8, wherein for the purpose of forming said second zone of the magnetic field of said magnetic track means the latter has at least two oppositely polarized permanent magnets situated at either side of said second zone.

12. An improved magnetic pattern control system according to claim 8, wherein said magnetic track means has two pole pieces of which at least one forms said continuous supporting surface and has at least one excision behind its supporting surface at the location of said second zone.

13. An improved magnetic pattern control system according to claim 12, wherein the pole piece forming said continuous supporting surface has two excisions defining said second zone and extending approximately transversely to the axis of the circular knitting machine.

* * * * *